US009607758B2

(12) United States Patent
Duval

(10) Patent No.: US 9,607,758 B2
(45) Date of Patent: Mar. 28, 2017

(54) MAGNETICALLY SHIELDED THREE-PHASE ROTARY TRANSFORMER

(71) Applicant: LABINAL POWER SYSTEMS, Blagnac (FR)

(72) Inventor: Cedric Duval, Samois sur Seine (FR)

(73) Assignee: LABINAL POWER SYSTEMS, Blagnac (FR)

( * ) Notice: Subject to any disclaimer, the term of this patent is extended or adjusted under 35 U.S.C. 154(b) by 156 days.

(21) Appl. No.: 14/400,143

(22) PCT Filed: May 3, 2013

(86) PCT No.: PCT/FR2013/050984
§ 371 (c)(1),
(2) Date: Nov. 10, 2014

(87) PCT Pub. No.: WO2013/167828
PCT Pub. Date: Nov. 14, 2013

(65) Prior Publication Data

US 2015/0137924 A1 May 21, 2015

(30) Foreign Application Priority Data

May 10, 2012 (FR) ..... 12 54291

(51) Int. Cl.
*H01F 30/12* (2006.01)
*H01F 30/14* (2006.01)
(Continued)

(52) U.S. Cl.
CPC ..... *H01F 38/18* (2013.01); *H01F 27/2823* (2013.01); *H01F 30/12* (2013.01)

(58) Field of Classification Search
CPC ..... H01F 38/18; H01F 30/12; H01F 29/12
(Continued)

(56) References Cited

U.S. PATENT DOCUMENTS 5,572,178 A * 11/1996 Becker ..... H01F 38/18 336/120
5,608,771 A * 3/1997 Steigerwald ..... A61B 6/56 378/15

(Continued)

FOREIGN PATENT DOCUMENTS

DE 199 53 583 C1 12/2001

OTHER PUBLICATIONS

International Search Report issued Aug. 6, 2013, in PCT/FR2013/050984, filed May 3, 2013.

*Primary Examiner* — Alexander Talpalatski
*Assistant Examiner* — Joselito Baisa
(74) *Attorney, Agent, or Firm* — Oblon, McClelland, Maier & Neustadt, L.L.P.

(57) ABSTRACT

A three-phase transformer including a primary portion and a secondary portion, the primary portion including a first body made of ferromagnetic material and primary coils, the secondary portion including a second body made of ferromagnetic material and secondary coils, the first body defining a first annular slot of axis A and a second annular slot of axis A. The primary coils include a first toroidal coil of axis A in the first slot, a second toroidal coil of axis A in the first slot, a third toroidal coil of axis A in the second slot, and a fourth toroidal coil of axis A in the second slot, the second coil and the third coil being connected in series.

9 Claims, 10 Drawing Sheets

(51) Int. Cl.

| | |
|---|---|
| ***H01F 21/04*** | (2006.01) |
| ***H01F 21/06*** | (2006.01) |
| ***H01F 38/18*** | (2006.01) |
| ***H01F 27/28*** | (2006.01) |

(58) Field of Classification Search
USPC ..... 336/5, 10, 12, 115, 119, 130
See application file for complete search history.

(56) References Cited

U.S. PATENT DOCUMENTS

| | | | | |
|---|---|---|---|---|
| 7,944,187 | B2 * | 5/2011 | Dooley | H02P 9/34 310/201 |
| 7,999,431 | B2 * | 8/2011 | Dooley | H02K 21/046 310/180 |
| 8,212,642 | B2 * | 7/2012 | Jaeger | B60C 23/0413 336/115 |
| 8,228,010 | B2 * | 7/2012 | Zadeh | H01F 38/18 318/115 |
| 8,421,570 | B2 * | 4/2013 | Schwander | H01F 41/061 336/118 |
| 2005/0140483 | A1 * | 6/2005 | Wobben | H01F 38/18 336/182 |
| 2006/0022785 | A1 * | 2/2006 | Dobbs | A61B 6/56 336/120 |
| 2011/0050377 | A1 | 3/2011 | Bjerknes et al. | |
| 2011/0141771 | A1 * | 6/2011 | Kyrberg | H02M 3/3376 363/21.04 |

* cited by examiner

FIG.13
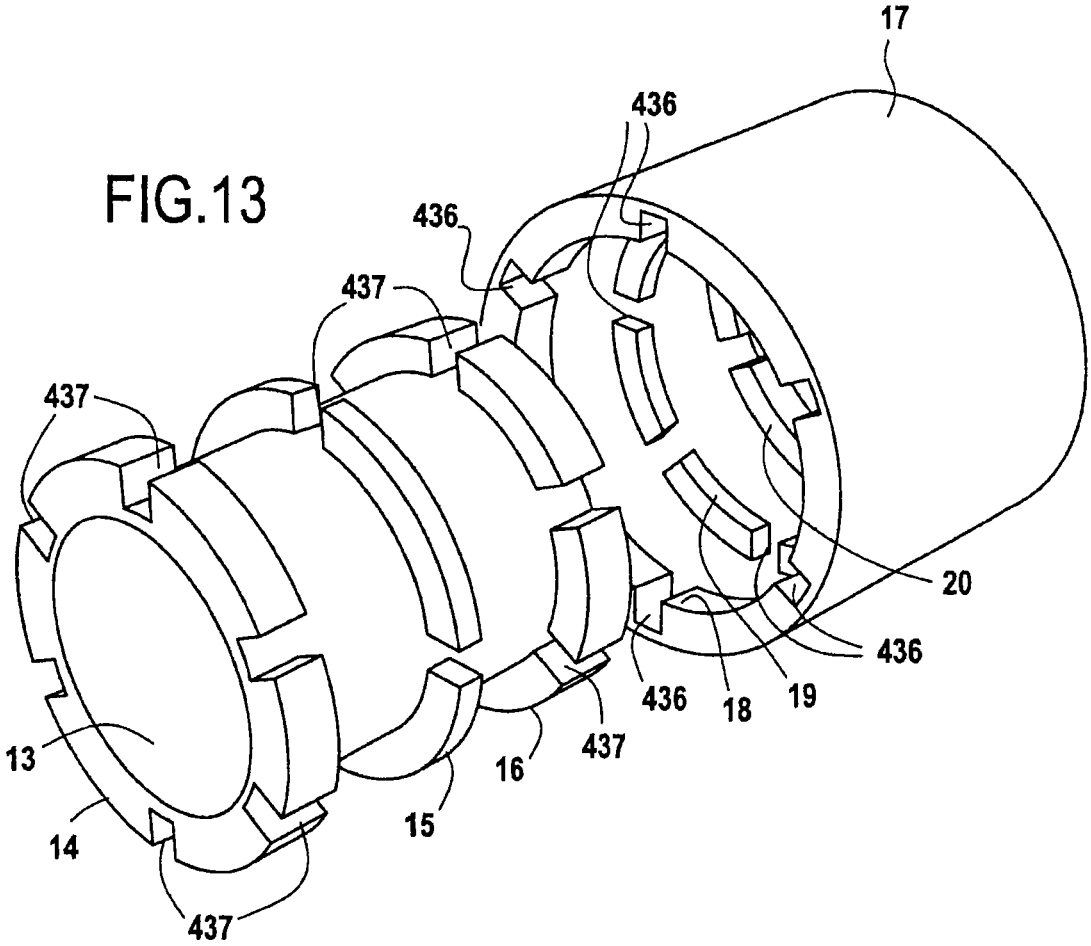
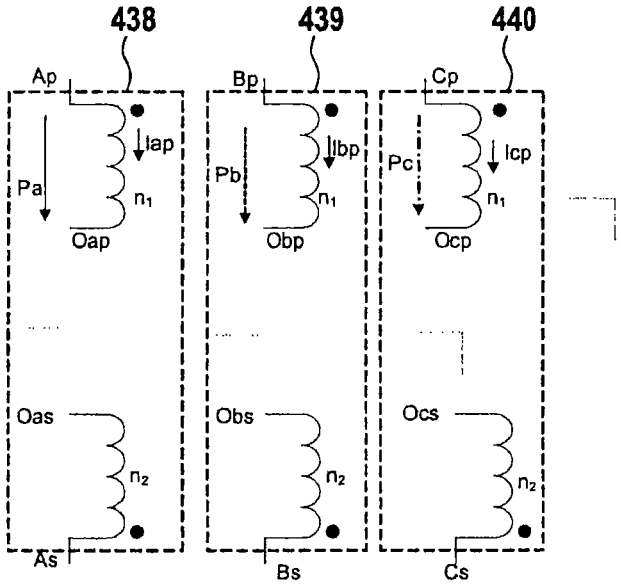
FIG.14

MAGNETICALLY SHIELDED THREE-PHASE ROTARY TRANSFORMER

BACKGROUND OF THE INVENTION

The present invention relates to the general field of transformers. In particular, the invention relates to a rotary three-phase transformer.

A rotary three-phase transformer serves to transfer energy and/or signals without contact between two axes rotating one relative to the other.

FIGS. 1 and 2 show respective rotary three-phase transformers 1 of the prior art.

The transformer 1 has three rotary single-phase transformers 2 corresponding to phases U, V, and W. Each rotary single-phase transformer 2 has a portion 3 and a portion 4 rotating one relative to the other about an axis A. By way of example, the portion 3 is a stator and the portion 4 is a rotor, or vice versa. In a variant, the portion 3 and the portion 4 are both movable in rotation relative to a stationary frame of reference (not shown). A toroidal coil 5 is received in a slot 6 defined by a body made of ferromagnetic material of the portion 3. A toroidal coil 7 is received in a slot 8 defined by a body made of ferromagnetic material of the portion 4. For each rotary single-phase transformer 2, the coils 5 and 7 form primary and secondary coils (or vice versa).

FIG. 1 shows a variant referred to as "U-shaped" in which the portion 3 surrounds the portion 4 about the axis A, while FIG. 2 shows a variant referred to as "E-shaped" or "pot-shaped", in which the portion 3 and the portion 4 are one beside the other in the axial direction.

The three-phase transformer 1 of FIG. 1 or 2 presents weight and volume that are large since it is not possible to make best use of the magnetic fluxes of each of the phases, unlike a static three-phase transformer with forced fluxes in which it is possible to couple the fluxes. Furthermore, in the example of FIG. 2, it is necessary to use electrical conductors of sections that differ as a function of the distance between the axis of rotation and the phase, in order to conserve balanced resistances.

Document US 2011/0050377 describes a four-column rotary three-phase transformer. That transformer presents considerable weight and volume. That document also describes a five-column rotary three-phase transformer. That transformer presents considerable weight and volume. Furthermore, it makes use of a radial winding passing via slots in the central columns of the magnetic circuit, where such a winding is more complex to perform than the toroidal winding used in the transformers of FIGS. 1 and 2.

There thus exists a need to improve the topology of a three-phase transformer.

OBJECT AND SUMMARY OF THE INVENTION

The invention provides a three-phase transformer having a primary portion and a secondary portion;

the primary portion comprising a first body made of ferromagnetic material and primary coils, the secondary portion comprising a second body made of ferromagnetic material and secondary coils;

the first body defining a first annular slot of axis A and a second annular slot of axis A, the first slot being defined by a first side leg, a central leg, and a ring, the second slot being defined by the central leg, a second side leg, and the ring; and the primary coils comprising a first toroidal coil of axis A in the first slot corresponding to a phase U, a second toroidal coil of axis A in the first slot, a third toroidal coil of axis A in the second slot, and a fourth toroidal coil of axis A in the second slot corresponding to a phase W, the second coil and the third coil corresponding to a phase V being connected in series;

wherein, the winding and connection directions of the second coil and of the third coil correspond, for a current flowing in the second coil and in the third coil, to a first magnetic potential for the second coil, and to a second magnetic potential opposite to the first magnetic potential for the third coil.

In this transformer, if three-phase currents are caused to flow in the primary coils in the appropriate directions, given the winding directions of the primary coils, then the magnetic potentials of the first and second primary coils are in opposition, and the magnetic potentials of the third and fourth primary coils are in opposition. That leads to flux coupling that enables the transformer to be of dimensions that are reduced in terms of volume and weight. Amongst other things, that leads to reproducing in the legs the coupled fluxes of a three-column three-phase static transformer with forced linked fluxes. Furthermore, the primary of the transformer makes use only of simple toroidal coils of axis A, thus enabling the structure to be particularly simple.

In an embodiment, the primary portion and the secondary portion are movable in rotation relative to each other about the axis A.

Under such circumstances, the invention provides a rotary three-phase transformer that, by virtue of its fluxes being coupled presents weight and volume that are reduced, in particular relative to using three single-phase rotary transformers.

In an embodiment, the second body defines a first annular secondary slot of axis A and a second annular secondary slot of axis A, the first secondary slot being defined by a first secondary side leg, a secondary central leg, and a secondary ring, the second secondary slot being defined by the secondary central leg, a second secondary side leg, and the secondary ring, the secondary coils comprising a first toroidal secondary coil of axis A in the first secondary slot corresponding to a phase U, a second toroidal secondary coil of axis A in the first secondary slot, a third toroidal secondary coil of axis A in the second secondary slot, and a fourth toroidal secondary coil of axis A in the second secondary notch corresponding to a phase W, the second secondary coil and the third secondary coil corresponding to a phase V being connected in series.

In this embodiment, the secondary is made on the same principle as the primary. The secondary thus also contributes to limiting the weight and the volume of the transformer, and enables the transformer to be constructed while using only toroidal coils of axis A.

In an embodiment, the second body defines a first annular secondary slot of axis A and a second annular secondary slot of axis A, the first secondary slot being defined by a first secondary side leg, a secondary central leg, and a secondary ring, the second secondary slot being defined by the secondary central leg, a second secondary side leg, and the secondary ring;

the secondary coils comprise one or more secondary coils connected in series, said secondary coils being wound around said secondary legs, passing in the slots in said secondary leg.

In this embodiment, the secondary is made on a principle that is different from that of the primary, while nevertheless presenting advantages that are similar. The secondary thus also contributes to limiting the weight and the volume of the transformer, and enables the transformer to be constructed while using in large part toroidal coils of axis A.

In an embodiment, the first side leg and the first secondary side leg are in line with each other and separated by an airgap, the first central leg and the first secondary central leg are in line with each other and separated by an airgap, and the second side leg and the second secondary side leg are in line with each other and separated by an airgap.

The primary portion may surround the secondary portion relative to the axis A, or vice versa. That corresponds to making a transformer that is referred to as being "U-shaped".

The primary portion and the secondary portion may be situated one beside the other in the direction of the axis A. That corresponds to making a transformer that is referred to as being "E-shaped" or "pot-shaped".

In an embodiment, the primary portion and the secondary portion are stationary relative to each other. A static transformer in accordance with the invention presents the same advantages as a rotary transformer in accordance with the invention.

In an embodiment, the first and second bodies made of ferromagnetic material completely surround the primary and the secondary coils.

Under such circumstances, the transformer is magnetically shielded.

BRIEF DESCRIPTION OF THE DRAWINGS

Other characteristics and advantages of the present invention appear from the following description made with reference to the accompanying drawings, which show implementations having no limiting character. In the figures:

FIG. 13 is an exploded view in perspective of the magnetic circuit of the FIG. 11 transformer;

FIG. 14 is an electrical circuit diagram showing the operation of the FIG. 13 transformer;

DETAILED DESCRIPTION OF EMBODIMENTS

Figure 3:
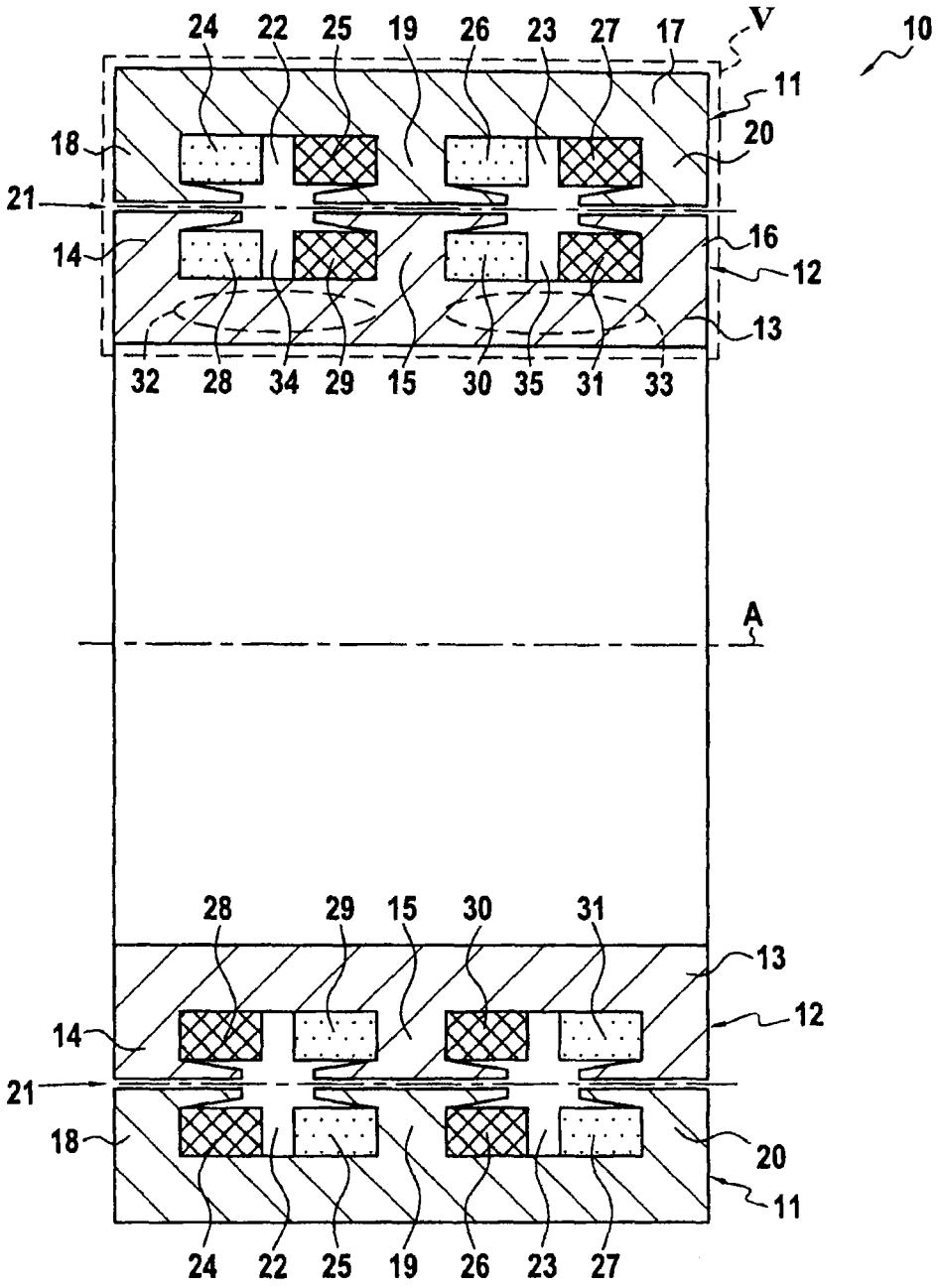
FIG. 3 is a section view of a magnetically shielded three-phase rotary transformer with forced linked fluxes in a first embodiment of the invention.

FIG. 3 is a section view of a rotary transformer 10 in a first embodiment of the invention. The transformer 10 is a magnetically shielded three-phase rotary transformer with forced linked fluxes.

The transformer 10 comprises a portion 11 and a portion 12 that are suitable for rotating relative to each other about an axis A. By way of example, the portion 11 is a stator and the portion 12 is a rotor, or vice versa. In a variant, the portion 11 and the portion 12 are both movable in rotation relative to a stationary frame of reference (not shown).

The portion 12 comprises a ring 13 of axis A and three legs 14, 15, and 16 made of ferromagnetic material. Each of the legs 14, 15, and 16 extends radially away from the axis A, starting from the ring 13. The leg 14 is at one end of the ring 13, the leg 16 is at another end of the ring 13, and the leg 15 lies between the legs 14 and 16. The ring 13 and the legs 14 and 15 define an annular slot 34 that is open in a radially outward direction. The ring 13 and the legs 15 and 16 define an annular slot 35 that is open in a radially outward direction. In general manner, the ring 13 and the legs 14, 15, and 16 form a body of ferromagnetic material defining two annular slots 34 and 35 that are open in a radially outward direction.

The portion 11 comprises a ring 17 of axis A and three legs 18, 19, and 20 made of the ferromagnetic material. The ring 17 surrounds the ring 13. Each of the legs 18, 19, and 20 extends radially towards the axis A, starting from the ring 17. The leg 18 is at one end of the ring 17, the leg 20 is at another end of the ring 17, and the leg 19 lies between the legs 18 and 20. The ring 17 and the legs 18 and 19 define an annular slot 22 that is open in a radially inward direction. The ring 17 and the legs 19 and 20 define an annular slot 23 that is open in a radially inward direction. In general manner, the ring 17 and the legs 18, 19, and 20 form a body of ferromagnetic material defining two annular slots 22 and 23 that are open in a radially inward direction.

The legs 14 and 18, 15 and 19, and also 16 and 20 face each other in pairs so as to define an airgap 21, thereby forming the columns of the transformer 10.

Figure 4:
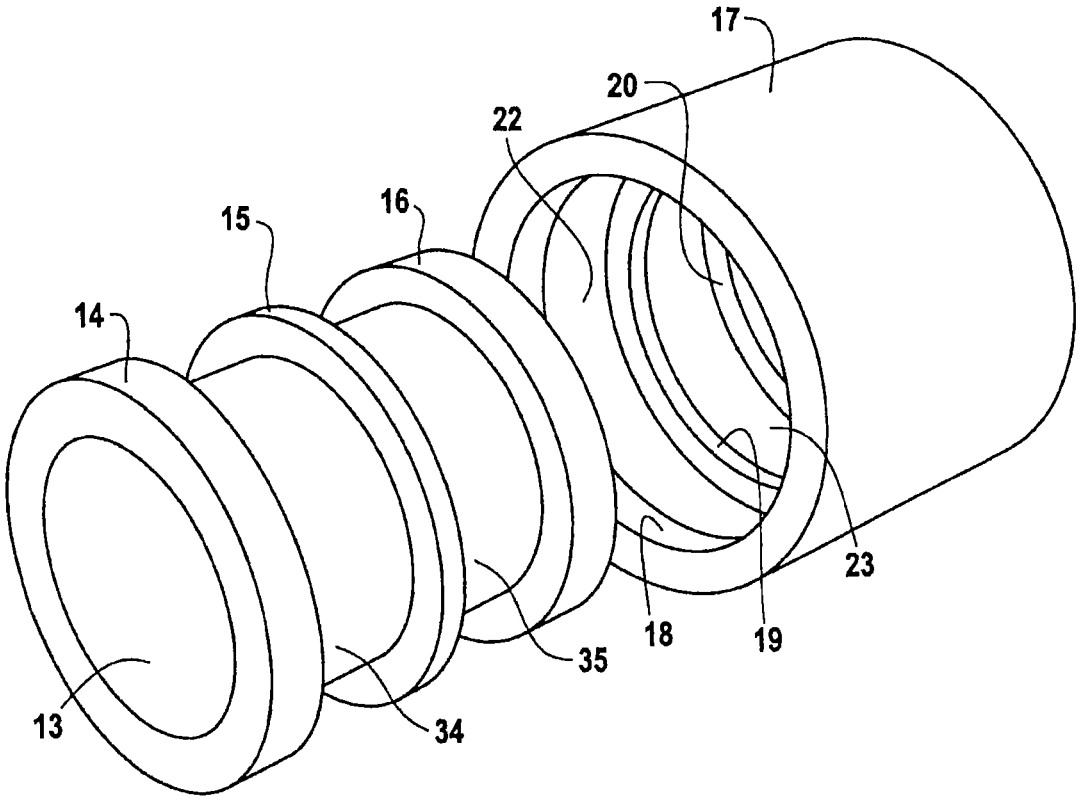
FIG. 4 is an exploded perspective view of the magnetic circuit of the FIG. 3 transformer.

The rings 13 and 17 together with the legs 14 to 16 and 18 to 20 form a magnetic circuit of the transformer 10. The transformer 10 is thus a three-column transformer. More precisely, the magnetic circuit of the transformer 10 has a first column (corresponding to the legs 14 and 18), a second column (corresponding to the legs 15 and 19), and a third column (corresponding to the legs 16 and 20). FIG. 4 is an exploded perspective view showing the magnetic circuit of the FIG. 10 transformer.

With reference once more to FIG. 3, the transformer 10 comprises coils 24, 25, 26, and 27 fastened to the portion 11, and coils 28, 29, 30, and 31 fastened to the portion 12. Below, the notation p and s is used with reference to a configuration in which the coils 24 to 27 are the primary coils of the transformer 10 and the coils 28 to 31 are the secondary coils of the transformer 10. Nevertheless, primary and secondary may naturally be inverted relative to the example described.

The coil 24 is a toroidal coil of axis A corresponding to a phase Up of the transformer 10. It is located in the slot 22. The coil 25 is a toroidal coil of axis A and it is located in the slot 22. The coil 26 is a toroidal coil of axis A, it is located in the slot 23, and it is connected in series with the coil 25. The coils 25 and 26 correspond to a phase Vp of the transformer 10. Finally, the coil 27 is a toroidal coil of axis A corresponding to a phase Wp of the transformer 10. It is located in the slot 23. Each of the coils 24 to 27 presents n1 turns. The term "toroidal coil of axis A" is used to mean a coil having its turns are wound around the axis A. The term "toroidal" is not used in the limited meaning referring to a solid as generated by rotating a circle about an axis. On the contrary, as in the examples shown, the section of a toroidal coil may be rectangular, in particular.

In corresponding manner, the coil 28 is a toroidal coil of axis A corresponding to a phase Up of the transformer 10. It is located in the slot 34. The coil 29 is a toroidal coil of axis A and it is located in the slot 34. The coil 30 is a toroidal coil of axis A, it is located in the slot 35, and it is connected in series with the coil 29. The coils 29 and 30 correspond to a phase Vs of the transformer 10. Finally, the coil 31 is a toroidal coil of axis A corresponding to a phase Ws of the transformer 10. It is located in the slot 35.

The coils 24, 25, 28, and 29 surround a magnetic core 32 situated in the ring 13. The term "magnetic core" is used to mean a portion of the magnetic circuit in which the same-direction flux created by the coil is in the majority. Electric currents flowing in the coils 24 and 25 thus correspond to magnetic potentials in the magnetic core 32. In corresponding manner, the coils 26, 27, 30, and 31 surround a magnetic core 33 situated in the ring 13. Electric currents flowing in the coils 26 and 27 thus correspond to magnetic potentials in the magnetic core 33.

Figure 5A:
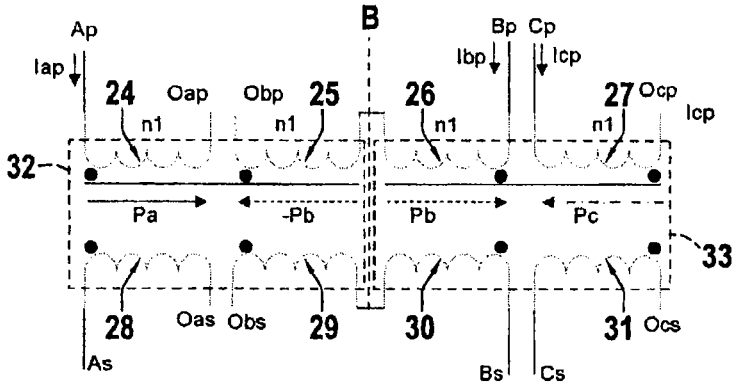
FIGS. 5A to 5E are electrical circuit diagrams showing a plurality of variants for connecting the coils of the FIG. 3 transformer.
Figure 5B:
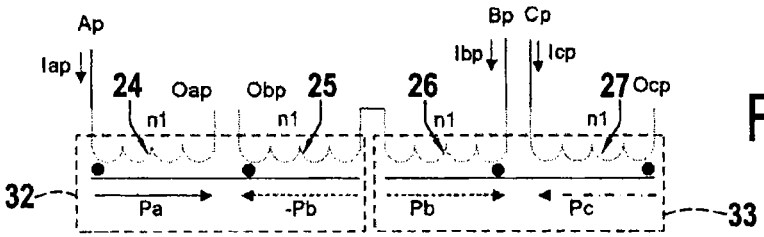
Figure 5C:
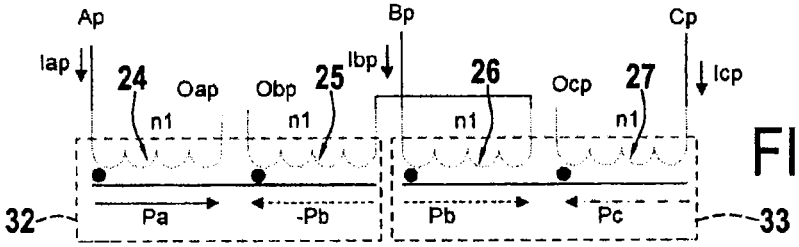
Figure 5D:
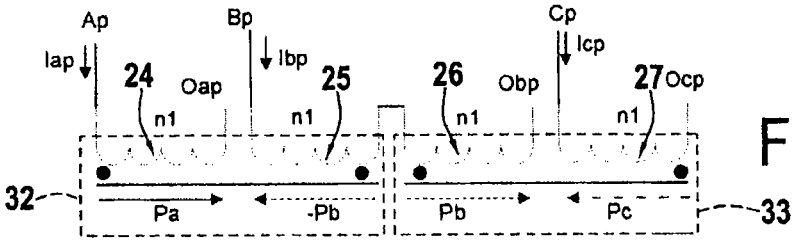
Figure 5E:
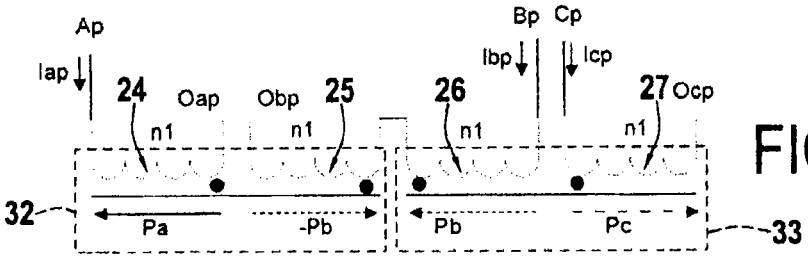

With reference to FIG. 5A, there follows an explanation of how the transformer 10 operates. In FIG. 5A, the following notation is used:

- $A_p$, $B_p$, and $C_p$, are the inlet points of the primary coils of the transformer 10. The phases U, V, and W of FIG. 3 correspond respectively to the phases A, B, and C of FIG. 4A, but all other types of correspondence are possible providing the same correspondence is used for the secondary.
- $I_{ap}$, $I_{bp}$, and $I_{cp}$ are the respective incoming currents at the points $A_p$, $B_p$, and $C_p$.
- $O_{ap}$, $O_{bp}$, and $O_{cp}$ are the connection points making possible electrical couplings identical to all kinds of static three-phase transformer (star-star, star-delta, delta-delta, delta-star, zigzag, . . . ).
- Black dots show the relationship between the current flowing in a coil and the direction of the corresponding magnetic potential: If the point is on the left of the coil, the coil is wound in a direction such that the magnetic potential created is in the same direction as the incoming current (clockwise winding). If the point is on the right of the coil, the winding direction causes the magnetic potential that is created to be in the opposite direction relative to the incoming current (winding in the counterclockwise direction).
- Pa, −Pb, Pb, and Pc are the magnetic potentials in the cores 32 and 33 corresponding respectively to the currents $I_{ap}$, $I_{bp}$, and $I_{cp}$;
- $A_s$, $B_s$, $C_s$, $O_{as}$, $O_{bs}$, and $O_{cs}$, are the outlet points and the points for connection to the secondary.

Given the winding directions and the series connection of the coils 25 and 26 shown in FIG. 5A, the current $I_{bp}$ corresponds, in the core 32, to a magnetic potential −Pb in the direction opposite to the magnetic potential Pa, and in the core 33, to a magnetic potential Pb in the direction opposite to the magnetic potential Pc.

FIGS. 5B to 5E are diagrams similar to that of FIG. 5A in which only of the primary is shown, and they show variant series connections and winding directions that enable the same effect to be obtained.

Thus, the transformer 10 makes it possible to generate magnetic potentials Pa, Pb, and Pc that are equal in modulus and opposite in direction on each magnetic core 32 and 33 and that are symmetrical relative to the axis of symmetry B between the two magnetic cores. Since two magnetic potential sources having a phase offset of $2\pi/3$ enable three three-phase voltage sources to be reconstituted that are mutually phase offset by $2\pi/3$, the transformer 10 can thus operate as a three-phase transformer with forced fluxes (with linked fluxes).

If the number of turns in the phases of the secondary is written $n_2$, then as in any three-phase transformer, the ratio of the voltages is given to a first approximation by $n_2/n_1$ and that of the currents by $n_1/n_2$. The rotary transformer 10 presents the same properties as any static three-phase transformer with linked (forced) fluxes, including the possibility of possessing a plurality of secondaries. The magnetic coupling performed by the magnetic circuit with the winding topologies of FIGS. 5A to 5E make it possible to have the same 3/2 coupling coefficient on the magnetic fluxes created as on a static three-phase transformer with forced fluxes relative to a single-phase transformer. In order to have the best coupling coefficient, it is necessary for the reluctances of each of the magnetic columns, due mainly to the airgap, to be equal. Specifically, as in a static three-phase transformer with forced fluxes, it is necessary to create equivalent reluctances in each of the columns that are higher than the reluctances of the magnetic material. In a rotary transformer, this is achieved naturally by the airgap.

The transformer 10 presents several advantages.

In particular, it can be seen that the magnetic circuit completely surrounds the coils 24 to 31. The transformer 10 is thus magnetically shielded. Furthermore, the coils 24 to 31 are all toroidal coils of axis A. The transformer 10 therefore does not require coils that are more complex in shape.

Furthermore, the phases of the transformer 10 may be balanced in inductance and in resistance.

Specifically, the inductance of the phase V that has a total of $2*n_1$ turns is nevertheless equal to the inductances of the phases U and W, each having $n_1$ turns, since the geometry of the magnetic circuit serves to cancel half of the flux in each half-coil. More precisely, the coil 25 has the same number of turns as the coil 24 and sees the same magnetic circuit, and the same applies for the coil 26 and the coil 27. However, the coils 24 and 27 are symmetrical with the same number of turns and their inductances are therefore equal. The coil 25 is wound in the opposite direction to the coil 26 and therefore has half of its flux cancelled because of the parallel connection of the central column (formed by the legs 15 and 19), and the same applies for the coil 26. The overall inductance of the coils 25 and 26 is thus equal to the overall inductance of the coils 24 and 27.

Resistances can be balanced by modifying the sections of the conductors in the coils. The sections of the phases U and W having $n_1$ turns are equal, whereas the section of the phase V that has $2*n_1$ turns is twice that of the preceding sections. Specifically, in order to conserve balanced resistances in the phases, the phase that is twice as long must also have twice the sectional area in order to compensate for its increase in length.

Finally, the transformer 10 presents reduced weight and volume.

Figure 1:
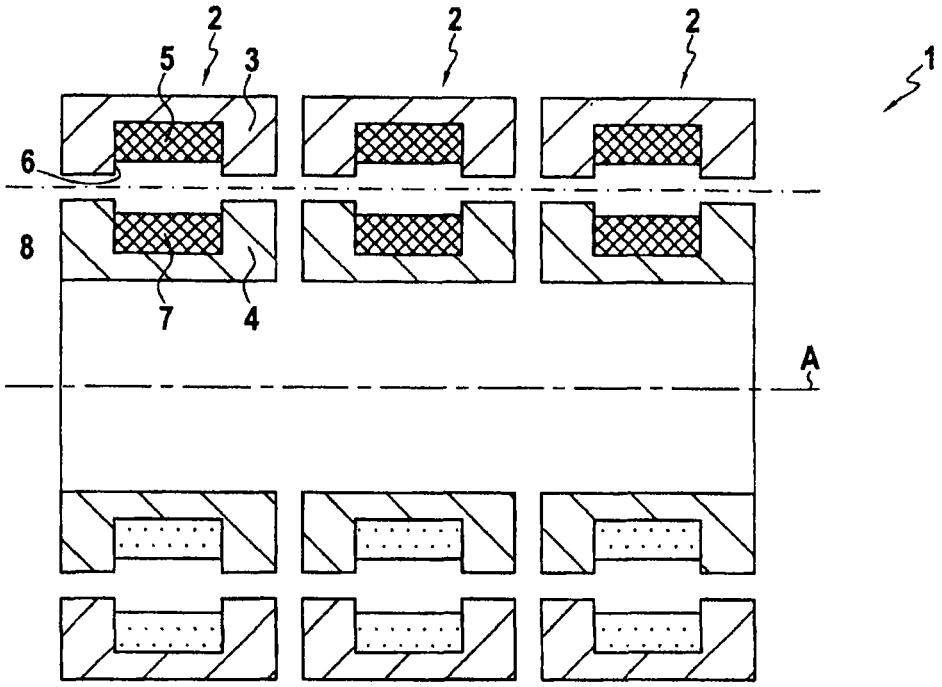
FIGS. 1 and 2 are section views of respective prior art rotary three-phase transformers.
Figure 2:
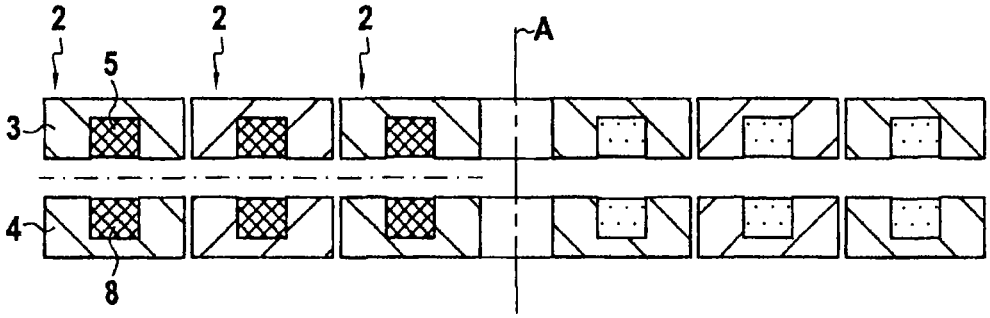

Specifically, if the transformer 10 is compared with the transformer 1 of FIG. 1 or FIG. 2, and assuming it is designed to provide the same performance, the following assumptions can be made:

Conductive material: Let Q be the quantity of conductive material in a coil of one of the three single-phase transformers of the transformer 1. The quantity of conductive material in the coils of the transformer 1 is thus 3Q.

Magnetic material: If the same reluctance Re is concerned for each column, each single-phase transformer of the transformer 1 has an overall reluctance of the magnetic circuit close to 2Re. For the transformer 10, the overall reluctance of the magnetic circuit is close to 3/2Re.

For the transformer 10, with the same magnetizing current and the same number of turns $n_1$ as for the transformer 1, the induction field and the flux is thus doubled. Specifically, for the transformer 1, the multiplying coefficient is 0.5 (i.e. the coupling coefficient=1 divided by the reluctance ratio=2) and for the transformer 10 with linked fluxes the modifying coefficient is 1 (i.e. the coupling coefficient=3/2 divided by the reluctance ratio=3/2). The ratio is thus indeed equal to 2 (1/0.5). This property makes it possible to evaluate approximately the possibilities for optimizing the transformer 10 relative to the transformer 1, for the same performance.

It is decided to reduce the number of turns by √2, thereby giving rise to an increase in the induction field of √2, while making it possible to have the same voltage for the same magnetizing current.

For a design having the same losses in joules and the same phase resistance, this gives:

For the coil 24, there need to be √2 fewer turns, and thus the quantity of conductive material is Q/√2. For constant losses in joules, the resistance (ρl/S) is also divided by √2 (length divided by √2), so in order to conserve losses in joules it is possible to divide the section by √2 for the same load current, magnetizing current, and voltage (in practice the saving might not be so great, since it is necessary to avoid local overheating, which depends on thermal conduction). The quantity of conductive material for the coil 24 is thus Q/2. The same reasoning applies to the coil 27.

For the coils 25 and 26, there need to be √2 fewer turns, and thus the quantity of conductive material is 2*Q/√2=√2*Q. At constant losses in joules, since the length is multiplied by √2 relative to a U-shaped single-phase transformer, the section is multiplied by √2. Consequently, the coils 25 and 26 require a quantity of conductive material equal to 2Q.

For constant phase resistance for the transformer 10, the overall quantity of conductive material is thus: Q/2+2Q+Q/2=3*Q. For the transformer 1, the quantity of conductive material was 3*Q, i.e. the same quantity. By way of comparison, for a static three-phase transformer, the quantity of conductive material is 3Q/2.

Concerning iron losses, in spite of the increase in the induction field B, it is assumed that its increase by √2 makes it possible to remain within non-saturated conditions (the high reluctance of the airgap favours designing the transformer 10 with a weak induction field in the magnetic material, it being necessary to increase the area of the airgap in order to decrease its reluctance, and that requires the area of magnetic material to be increased).

Losses by hysteresis are given by $K_H B^2 f^2 * V$ and current losses are given by $K_F B^2 f^2 * V$, with:

V: volume;

f: utilization frequency;

B: maximum induction field;

$K_H$: a constant associated with the magnetic materials and with the structure of the magnetic circuit; and $K_F$: a constant associated with the magnetic materials and with the structure of the magnetic circuit.

Losses are thus twice as great per unit volume when transposing the standard rotary transformer 1 to the three-phase transformer 10 with forced flux ($(\sqrt{2}\ B)^2=2B^2$).

If the saving in volume of the magnetic circuit is evaluated, it can be estimated that the volume is decreased by about 42%, which means that there is an overall increase of about 16% for iron losses (0.58*2=1.16). This naturally depends on the initial dimensioning. With a rotary transformer, iron losses are much less than joule losses and it can thus be considered that the increase in overall losses (less than 8%) is negligible.

Figure 6A:
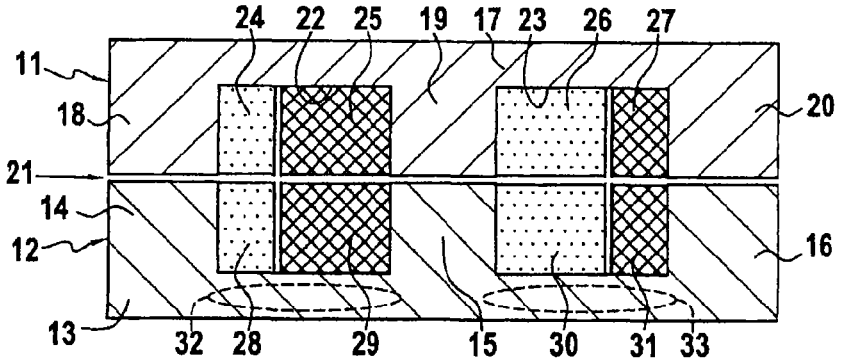
FIGS. 6A to 6C show respective details of FIG. 3 in different positioning variants for the coils.
Figure 6B:
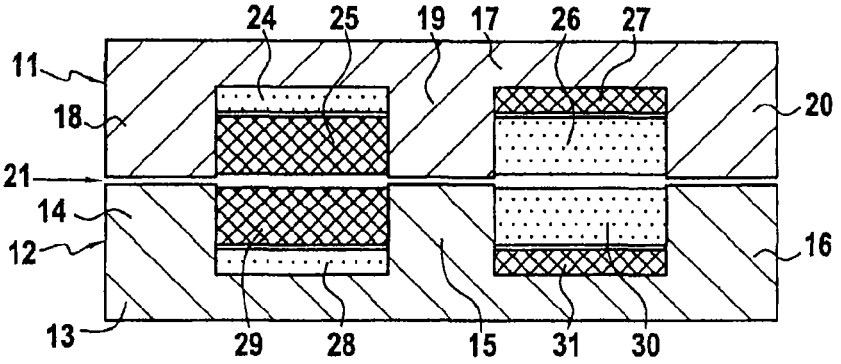
Figure 6C:
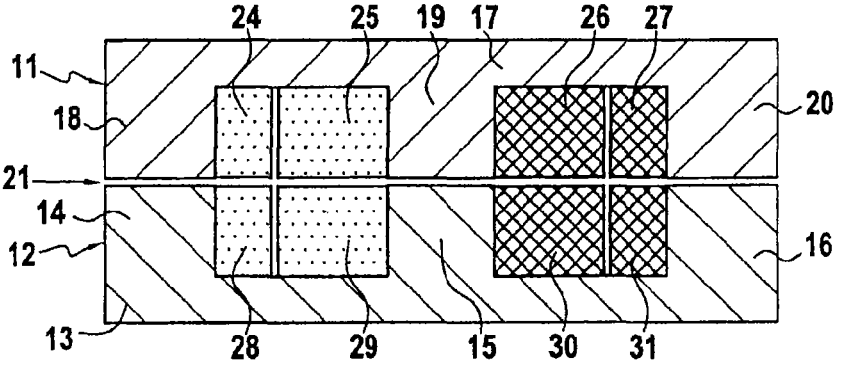

The positions of the coils 24 to 31 shown in FIG. 3 constitute one example, and other positions can be suitable. FIGS. 6A to 6C, which correspond to detail V in FIG. 3, show respective different possibilities for positioning the coils 24 to 31. In FIG. 6A, in a slot 22 or 23, the coils are next to each other in the axial direction, and they are wound in opposite directions. In FIG. 6B, in a slot 22 or 23, the coils are wound around each other about the axis A, and they are wound in opposite directions. In FIG. 6C, in a slot 22 or 23, the coils are next to each other in the axial direction, and they are wound in the same direction. In a variant that is not shown, the coils in a slot 22 or 23 are mixed.

Figure 7:
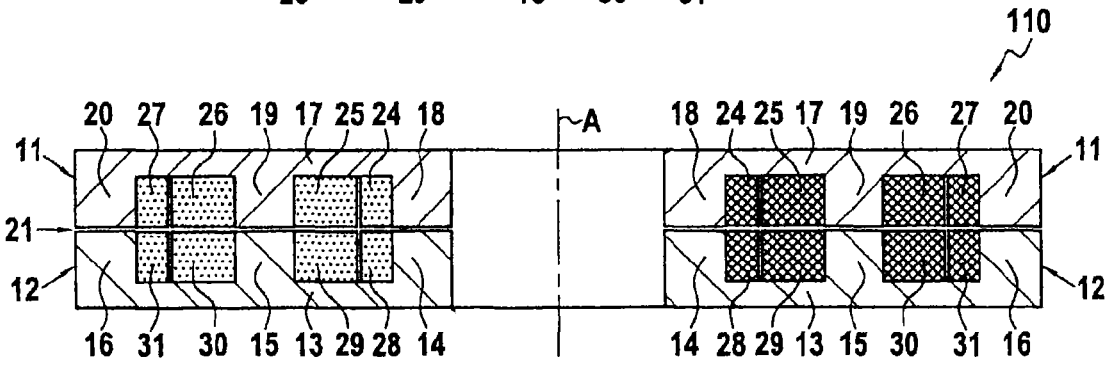
FIG. 7 is a section view of a magnetically shielded three-phase rotary transformer with forced linked fluxes in a second embodiment of the invention.
Figure 8:
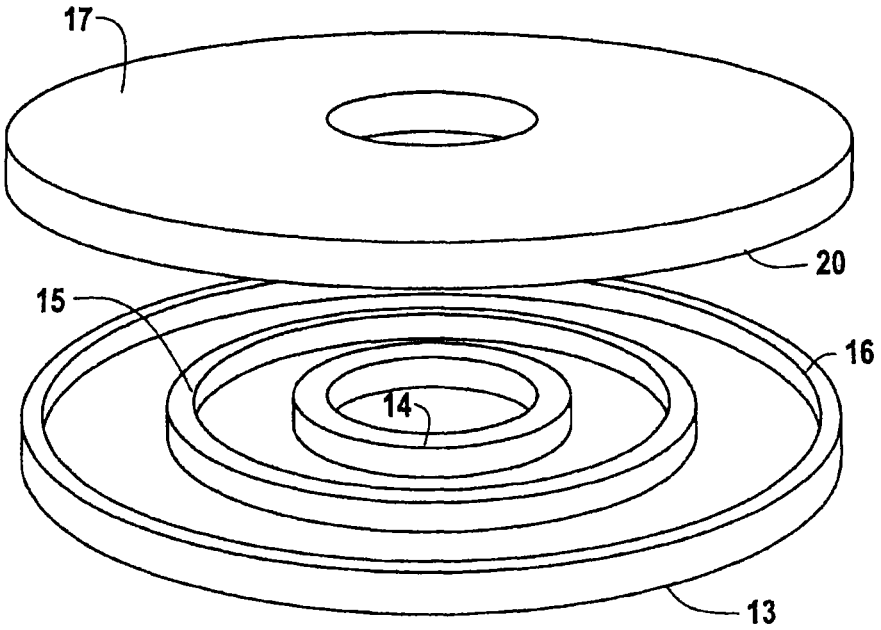
FIG. 8 is an exploded perspective view of the magnetic circuit of the FIG. 7 transformer.

FIG. 7 shows a transformer 110 in a second embodiment of the invention. The transformer 110 may be considered as being an "E-shaped" or a "pot-shaped" variant of the "U-shaped" transformer 10 of FIG. 3. The same references are therefore used as in FIG. 6 and in FIG. 3, without risk of confusion, and a detailed description of the transformer 110 is omitted. As can be seen in FIG. 8, which is an exploded perspective view of the magnetic circuit of the transformer 110, It is merely mentioned that the references 13 and 17 correspond to two axially spaced-apart rings, the legs 14 to 16 and 18 to 20 extending axially between the two rings 13 and 17, and that the magnetic cores in this example are situated in the columns.

Figure 9:
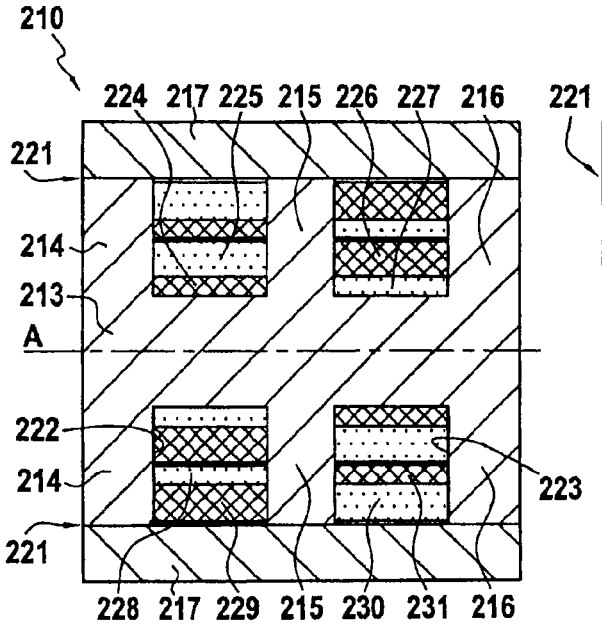
FIG. 9 is a section view of a magnetically shielded three-phase rotary transformer with forced linked fluxes in a third embodiment of the invention.

FIG. 9 shows a transformer 210 in a third embodiment of the invention. The transformer 210 may be considered as a static transformer corresponding to the rotary transformer 10 of FIG. 3. In FIG. 9, the same references are therefore used as in FIG. 3, plus 200, in order to designate elements that are identical or similar to those of FIG. 3.

The transformer 210 has a ring 213 about the axis A, three legs 214, 215, and 216, and a ring 217 of the ferromagnetic material about the axis A. Each of the legs 214, 215, and 216 extends radially away from the axis A, starting from the ring 213. The leg 214 is at one end of the ring 213, the leg 216 is at another end of the ring 213, and the leg 215 lies between the legs 214 and 216. The ring 217 that surrounds the ring 213 and the legs 214 to 216, defining an airgap 221.

The rings 213 and 217 together with the legs 214 to 216 form a three-column magnetic circuit of the transformer 210. More precisely, the magnetic circuit of the transformer 210 has a first column (corresponding to the leg 214), a second column (corresponding to the leg 215), and a third column (corresponding to the leg 216).

The magnetic circuit of the transformer 210 defines a slot 222 between the two rings, the first column and the second column, and a slot 223 between the two rings, the second column, and the third column.

The transformer 210 has coils 224, 225, 226, and 227, and coils 228, 229, 230, and 231.

The coil 224 is a toroidal coil of axis A corresponding to a phase Up of the transformer 210. It is located in the slot 222. The coil 225 is a toroidal coil of axis A and it is located in the slot 222. The coil 226 is a toroidal coil of axis A, it is located in the slot 223, and it is connected in series with the coil 225. The coils 225 and 226 correspond to a phase Vp of the transformer 210. Finally, the coil 227 is a toroidal coil of axis A corresponding to a phase Wp of the transformer 210. It is located in the slot 223.

In corresponding manner, the coil 228 is a toroidal coil of axis A corresponding to a phase Up of the transformer 210. It is located in the slot 222. The coil 229 is a toroidal coil of axis A and it is located in the slot 222. The coil 230 is a toroidal coil of axis A, it is located in the slot 223, and it is connected in series with the coil 229. The coils 229 and 230 correspond to a phase Vs of the transformer 210. Finally, the coil 231 is a toroidal coil of axis A corresponding to a phase Ws of the transformer 210. It is located in the slot 223.

The transformer 210 is a magnetically shielded three-phase static transformer with forced linked fluxes, and with a three-column magnetic circuit. It presents operation and advantages similar to the transformer 10 of FIG. 3.

Figure 10:
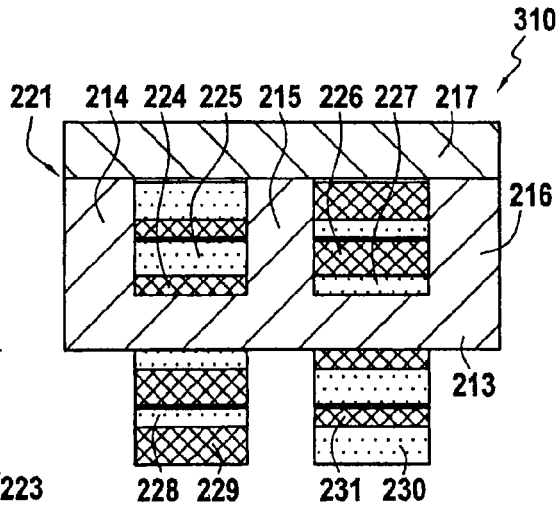
FIG. 10 is a section view of a magnetically shielded three-phase rotary transformer with forced linked fluxes in a fourth embodiment of the invention.

FIG. 10 shows a transformer 310 in a fourth embodiment. The transformer 310 may be considered as being a magnetically non-shielded variant of the magnetically shielded transformer 210 of FIG. 7. The same references are therefore used as in FIG. 8 and in FIG. 7, without risk of confusion, and a detailed description of the transformer 310 is omitted. It is merely stated that the magnetic circuit of the transformer 310 does not completely surround the coils 224 to 231, and that the transformer 310 is thus not magnetically shielded, unlike the transformer 210.

Figure 11:
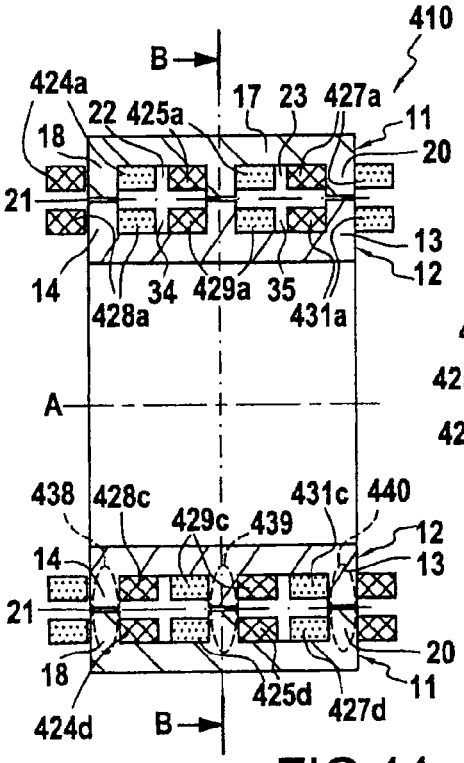
FIG. 11 is a section view of a three-phase rotary transformer with forced linked fluxes in a first embodiment useful for understanding the invention.
Figure 12:
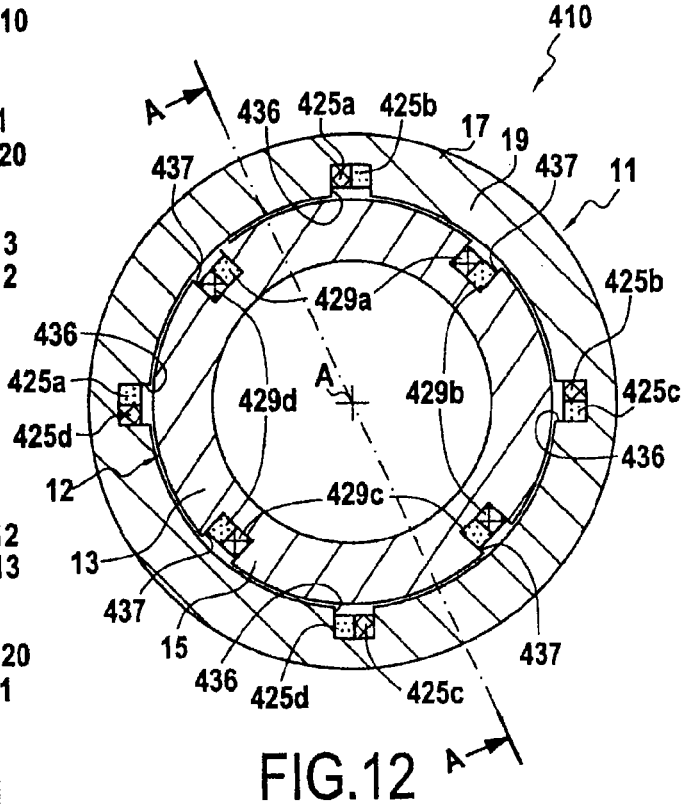
FIG. 12 is a another section view of the FIG. 11 transformer.

FIGS. 11, 12, and 13 show a transformer 410 in a first embodiment useful for understanding the invention. The transformer 410 may be considered as a three-phase rotary transformer with forced linked fluxes, and it may be considered as a variant of the transformer 10 of FIG. 3. Thus, in FIGS. 11 to 13, elements that are identical or similar to elements of the transformer 10 of FIG. 3 are designated by the same references, without risk of confusion. Below, the specific features of the transformer 410 are described in detail.

Instead of the toroidal coil 24, the transformer 410 has four coils, of which a coil 424*a* and a coil 424*d* are shown in FIG. 11, these coils are connected in series and are received in slots 436 formed in the leg 18. In corresponding manner, instead of the toroidal coil 28, the transformer 410 has four coils, of which a coil 428*a* and a coil 428*d* are shown in FIG. 11, these coils are connected in series and are received in slots 437 formed in the leg 15.

Instead of the toroidal coils 25 and 26, the transformer 410 has coils 425*a*, 425*b*, 425*c*, and 425*d* that are connected in series and that are received in slots 436 formed in the leg 19, as shown in FIG. 12. In corresponding manner, instead of the toroidal coils 29 and 30, the transformer 410 has coils 429*a*, 429*b*, 429*c*, and 429*d* that are connected in series and that are received in slots 437 formed in the leg 15.

Likewise, instead of the toroidal coil 27, the transformer 410 has four coils, of which a coil 427*a* and a coil 427*d* are shown in FIG. 11, these coils are connected in series and are received in slots 436 formed in the leg 20. In corresponding manner, instead of the toroidal coil 31, the transformer 410 has four coils, of which a coil 431*a* and a coil 431*d* are shown in FIG. 11, these coils are connected in series and are received in slots 437 formed in the leg 16.

In other words, the phases are no longer wound around the axis of rotation A, but radially around each of the columns. The transformer 410 thus has three radial magnetic cores: A core 438 in the column formed by the legs 14 and 18, a core 439 in the column formed by the legs 15 and 19, and a core 440 in the column formed by the legs 16 and 20.

FIG. 14 uses the same notation as in FIGS. 5A to 5E, and it illustrates the operation of the transformer 410.

In FIG. 14, the coils 424*a*, 424*d*, and the coils that are not shown and that are connected thereto correspond, for a current $I_{ap}$, to a radial magnetic potential Pa directed towards the axis A in the magnetic core 438. Likewise, the coils 425*a*, 425*b*, 425*c*, and 425*d* correspond, for a current $I_{bp}$, to a radial magnetic potential Pb directed towards the axis A in the magnetic core 439. Finally, the coils 427*a*, 427*d*, and the coils that are not shown and that are connected thereto correspond, for a current $I_{ac}$, to a radial magnetic potential Pc directed towards the axis A in the magnetic core 440.

The magnetic potentials Pa, Pb, and Pc are equal in modulus, and they are all directed towards the axis A. In a variant that is not shown, the magnetic potentials Pa, Pb, and Pc are in the direction opposite relative to the example shown, i.e. they are all directed away from the axis A.

This configuration enables fluxes to be properly coupled. More precisely, the topology of the transformer 410 makes it possible to obtain the same coupling coefficient of 3/2 as in the above-described transformer 10. In order to obtain the theoretical coupling coefficient and three-phase balance, it suffices for the reluctances between the midpoint of the ring 17 and the midpoint of the ring 13 and passing via each of the columns to be identical.

The transformer 410 presents the same advantages as the transformer 10, other than the use of toroidal coils only. In particular, the transformer 410 makes it possible to obtain coupling of the phases that enables the multiplicative coefficient of 3/2 to be obtained.

In the embodiment shown, the transformer 410 comprises, for each phase, four primary coils in series (coils 425*a* to 425*d* for the central phase) and four secondary coils in series (coils 429*a* to 429*d* for the central phase). In a variant, the number of coils on each column could be greater or smaller. They may be different numbers of coils on each column for the primary and for the secondary.

Figure 15:
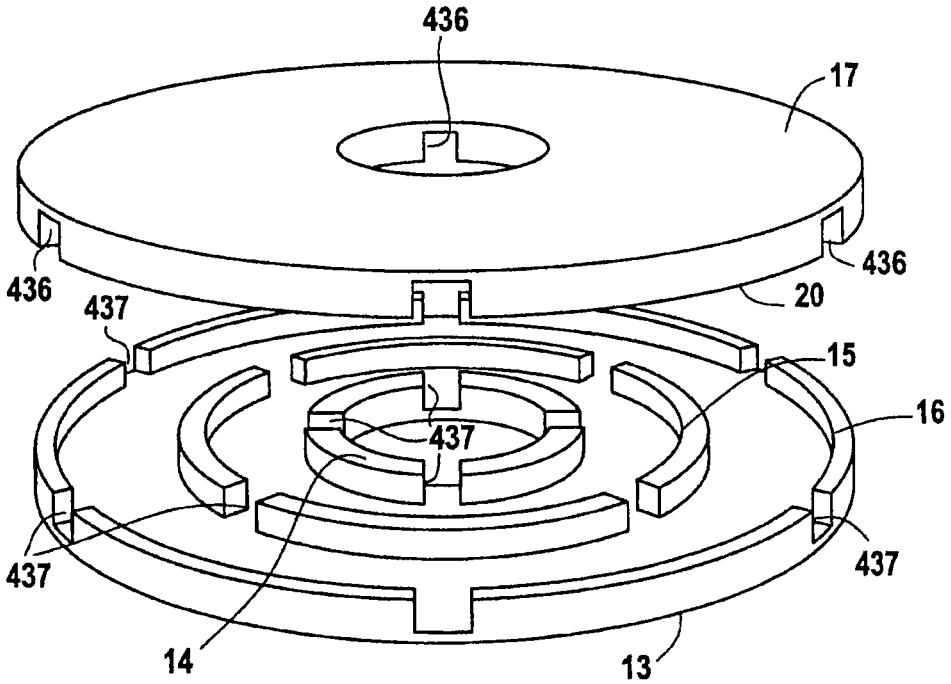
FIG. 15 is an exploded view in perspective of the magnetic circuit of a transformer in a second embodiment useful for understanding the invention, that may be considered as being a variant of the FIG. 11 transformer.

The transformer 410 shown in FIGS. 11 to 13 is a "U-shaped" transformer. In a variant that is not shown, an "E-shaped" or a "pot-shaped" transformer would present similar topology. Under such circumstances, the magnetic cores would be axial. FIG. 15 shows, in an exploded perspective view, a magnetic circuit suitable for making such an "E-shaped" variant. Elements corresponding to elements of FIG. 13 are designated by the same references, without risk of confusion.

In the transformer 10 of FIG. 3, and in the transformer 410 of FIG. 11, the coils enable three-phase fluxes to be reproduced in the three columns of the transformer in a manner that is equivalent to a three-phase static transformer with forced linked fluxes. Likewise, in the transformer 110 of FIG. 7, and in the "E-shaped" variant of the transformer 410 (not shown but based on the magnetic circuit of FIG. 15), the coils enable three-phase fluxes to be reproduced in the three columns of the transformer in a manner that is equivalent to a three-phase static transformer with forced linked fluxes.

Thus, the primaries and the secondaries of these transformers are compatible. In general manner, the primary of the transformer 10 is compatible with any secondary of topology making it possible to reproduce the three-phase fluxes in the three columns in a manner that is equivalent to a three-phase static transformer with forced linked fluxes.

Thus, in the transformer 10, the primary and the secondary are made on the same principle. Nevertheless, in a variant, the primary or the secondary could be made on a different principle, e.g. on the principle of the transformer 410 of FIGS. 11 to 13.

Figure 16:
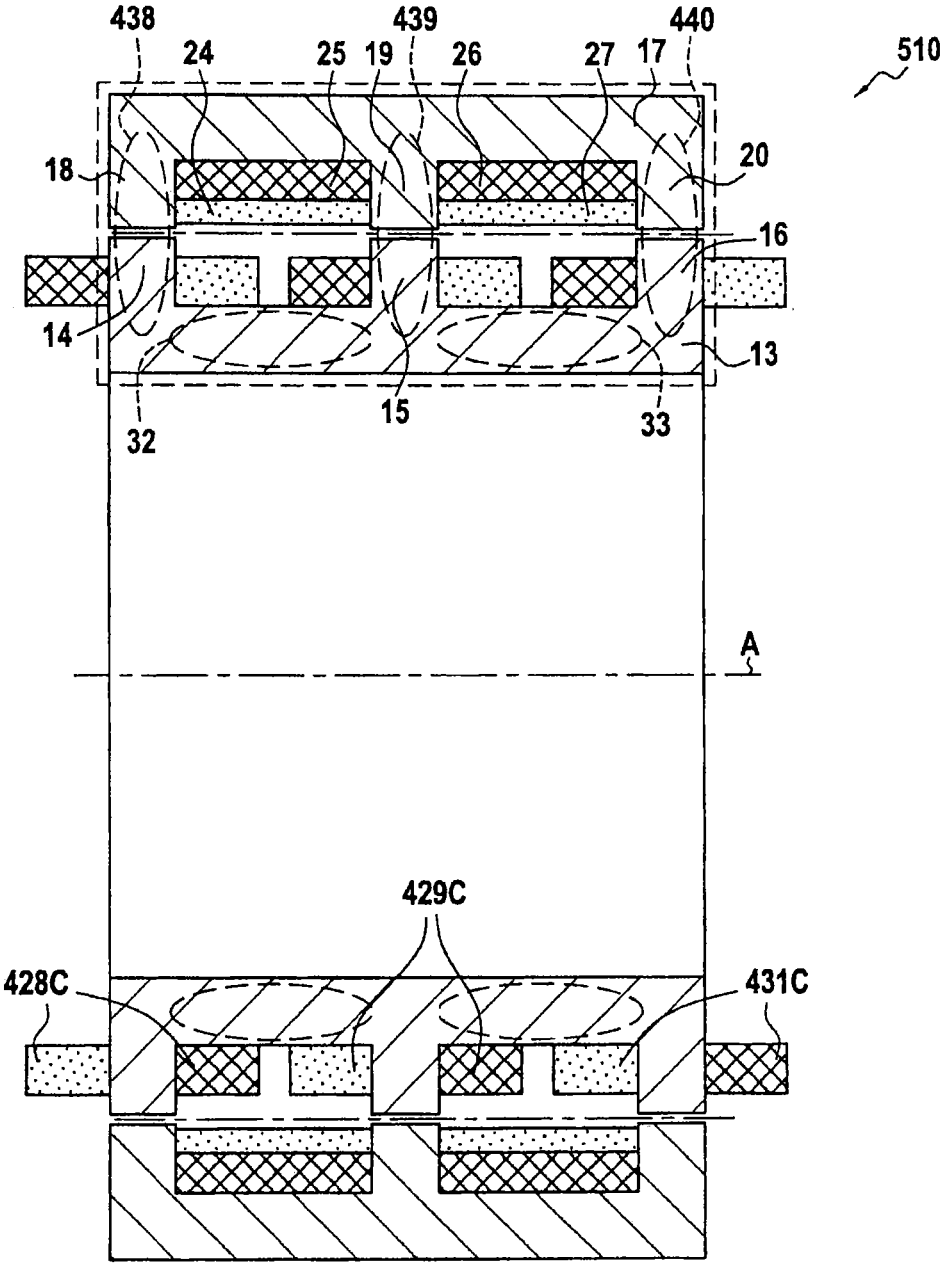
FIG. 16 is a section view of a rotary transformer with forced linked fluxes in a fifth embodiment of the invention.

FIG. 16 is a section view of a transformer 510 in a fifth embodiment, using the primary of the transformer 10 and the secondary the transformer 410. In FIG. 16, the same references are therefore used as in FIG. 3, or in FIG. 11, and a detailed description is omitted.

In known manner, a transformer may have a plurality of secondaries. Thus, in an embodiment not shown, the coils of each secondary may be made simultaneously using the principle of the transformer 10 and the principle of the transformer 410 on a common body, providing it possesses the necessary slots in its legs for passing coils using the principle of the transformer 410.

The invention claimed is:

1. A three-phase transformer comprising:

a primary portion and a secondary portion;

the primary portion comprising a first body made of ferromagnetic material and primary coils, the secondary portion comprising a second body made of ferromagnetic material and secondary coils;

the first body defining a first annular slot of axis A and a second annular slot of axis A, the first slot being defined by a first side leg, a central leg, and a ring, the second slot being defined by the central leg, a second side leg, and the ring; and the primary coils comprising a first toroidal coil of axis A in the first slot corresponding to a phase U, a second toroidal coil of axis A in the first slot, a third toroidal coil of axis A in the second slot, and a fourth toroidal coil of axis A in the second slot corresponding to a phase W, the second coil and the third coil corresponding to a phase V being connected in series;

wherein the winding and connection directions of the second coil and of the third coil correspond, for a current flowing in the second coil and in the third coil, to a first magnetic potential for the second coil, and to a second magnetic potential opposite to the first magnetic potential for the third coil.

2. A transformer according to claim 1, wherein the primary portion and the secondary portion are movable in rotation relative to each other about the axis A.

3. A transformer according to claim 2, wherein the second body defines a first annular secondary slot of axis A and a second annular secondary slot of axis A, the first secondary slot being defined by a first secondary side leg, a secondary central leg, and a secondary ring, the second secondary slot being defined by the secondary central leg, a second secondary side leg, and the secondary ring;

the secondary coils comprising a first toroidal secondary coil of axis A in the first secondary slot corresponding to a phase U, a second toroidal secondary coil of axis A in the first secondary slot, a third toroidal secondary coil of axis A in the second secondary slot, and a fourth toroidal secondary coil of axis A in the second secondary slot corresponding to a phase W, the second secondary coil and the third secondary coil corresponding to a phase V being connected in series.

4. A transformer according to claim 3, wherein the first side leg and the first secondary side leg are in line with each other and separated by an airgap, the first central leg and the first secondary central leg are in line with each other and separated by an airgap, and the second side leg and the second secondary side leg are in line with each other and separated by an airgap.

5. A transformer according to claim 2, wherein the second body defines a first annular secondary slot of axis A and a second annular secondary slot of axis A, the first secondary slot being defined by a first secondary side leg, a secondary central leg, and a secondary ring, the second secondary slot being defined by the secondary central leg, a second secondary side leg, and the secondary ring;

the secondary coils comprise one or more secondary coils connected in series, the secondary coils, being wound around the secondary legs, passing in the slots in the secondary leg.

6. A transformer according to claim 2, wherein the primary portion surrounds the secondary portion relative to the axis A, or vice versa.

7. A transformer according to claim 2, wherein the primary portion and the secondary portion are situated one beside the other in the direction of the axis A.

8. A transformer according to claim 1, wherein the primary portion and the secondary portion are stationary relative to each other.

9. A transformer according to claim 1, wherein the first and second bodies made of ferromagnetic material completely surround the primary and the secondary coils.

* * * * *